US005775872A

United States Patent [19]

Seidl et al.

[11] Patent Number: 5,775,872

[45] Date of Patent: Jul. 7, 1998

[54] PROCESS AND DEVICE TO FORM A STACK OF GROUPED PIECES OF MATERIAL

[75] Inventors: Maximilian R. Seidl; Manfred Adler, both of Eching, Germany

[73] Assignee: Avery Dennison Corporation, Pasadena, Calif.

[21] Appl. No.: 511,264

[22] Filed: Aug. 4, 1995

(Under 37 CFR 1.47)

[30] Foreign Application Priority Data

Aug. 5, 1994 [DE] Germany ..... 44 27 801.2

[51] Int. Cl.[6] ..... B65G 57/02

[52] U.S. Cl. ..... 414/789.5; 53/157; 414/786

[58] Field of Search ..... 53/157; 414/786, 414/789.5

[56] References Cited

U.S. PATENT DOCUMENTS 2,635,965 4/1953 Hensgen et al. ..... 53/157 X 2,667,420 1/1954 Muelemans et al. ..... 414/789.5 X 3,664,089 5/1972 Keck ..... 53/157 X

FOREIGN PATENT DOCUMENTS 131039 5/1987 U.S.S.R. ..... 414/789.5

*Primary Examiner*—Janice L. Krizek

*Attorney, Agent, or Firm*—Christie, Parker & Hale, LLP

[57] ABSTRACT

The invention reports a process and a device to form a stack of grouped pieces of material on a base, in which a free end of a continuous separating strip serving to separate the groups is secured in the region of the base, and between groups of pieces of material forming the stack with the alternating placement of groups of material and sections of the separating strip continued until the last group of pieces of material is placed on the stack.

16 Claims, 2 Drawing Sheets

10
12
14
16
17
18a
18b
19
20a
20b
22a
22b
24a
24b
25
26
27a
27b
28
30

20b
24b
22b
17
40
40'
12
27b
25
19
27a
20a
24a
14
18b
18a
16
28
30
22a
26

PROCESS AND DEVICE TO FORM A STACK OF GROUPED PIECES OF MATERIAL

FIELD OF THE INVENTION

The invention relates to a process and apparatus for forming a stack of grouped pieces of material, in particular labels.

BACKGROUND OF THE INVENTION

When pieces of material which are to be combined into various groups are placed in a stack, it is often desirable for further processing that the individual groups of pieces within the stack be readily identifiable.

In practice, this desire arises with the fabrication of labels, with which, for example, goods are to be identified. The raw material for the labels is usually in roll form, folded strips or sheets, or accordion folded. This raw material is printed with the desired information from which labels are cut and separated into singles. Groups of labels and pieces of material refer to corresponding groups of different goods, so the labels must remain in their groups to facilitate further processing.

For this purpose, the prior art has suggested to place the respective groups of pieces or labels laterally staggered relative to each other, so that the various groups can be kept separate from each other. Frequently, however, individual groups merge into another such that the labels must later be re-sorted manually. This happens frequently during transport and in storage. If relatively small groups of individual labels are provided with different inscriptions, or if the labels are very small, the individual groups are very difficult to keep separate despite the staggered placement.

Another suggestion from the prior art consists of making a grouping in that the labels of one group have a uniform size differing from those of another group, such that groups of labels with different inscriptions can be kept separate from each other by the outwardly visible difference in size. The control processes required for separation of different-sized pieces of material are, however, disproportionately expensive compared to the desired effect of the grouping.

SUMMARY OF THE INVENTION

The object of the present invention is to improve the known processes and devices for grouping pieces of material and to avoid the aforementioned disadvantages of the prior art and at a low cost. In particular, a process and a device are proposed which enable grouping pieces of material simply but efficiently.

A process for forming a vertically oriented stack of grouped pieces of substantially planar materials comprises providing a horizontally oriented base, attaching to the base a first free end of a continuous separating strip provided to separate the grouped pieces of materials forming the stack, layering pieces forming a first group of materials on the base with a lowermost piece of the first group contacting the base and the uppermost piece of the first group facing upwards, depositing a section of the separating strip on the uppermost piece of the first group and placing the next group of materials forming the stack on the first grouping of materials with the lowermost piece of the pieces of material forming the next group on top of the uppermost piece of material of the first group with a section of the separating strip located thereon, then completing the stack by alternately stacking groups of the pieces of materials with sections of separating strip positioned between groups of pieces of materials.

The apparatus for forming a stack of grouped pieces of material comprises a horizontally oriented base, means to secure one end of a separating strip to said base, means to align grouped pieces of material on the base to form a vertically oriented stack, and means to add sequential sections of a continuous separating strip over the uppermost piece of each of the group of pieces of material by arcuately oscillatory movements over the top of the stack undergoing formation.

BRIEF DESCRIPTION OF THE DRAWINGS

In the following, the present invention is presented using a preferred embodiment. In the process, additional characteristics and advantages of this invention are disclosed. The drawings depict.

In the figures, identical or at least functionally identical parts are numbered with identical reference numerals.

DETAILED DESCRIPTION

Figures 1, 2, 3:
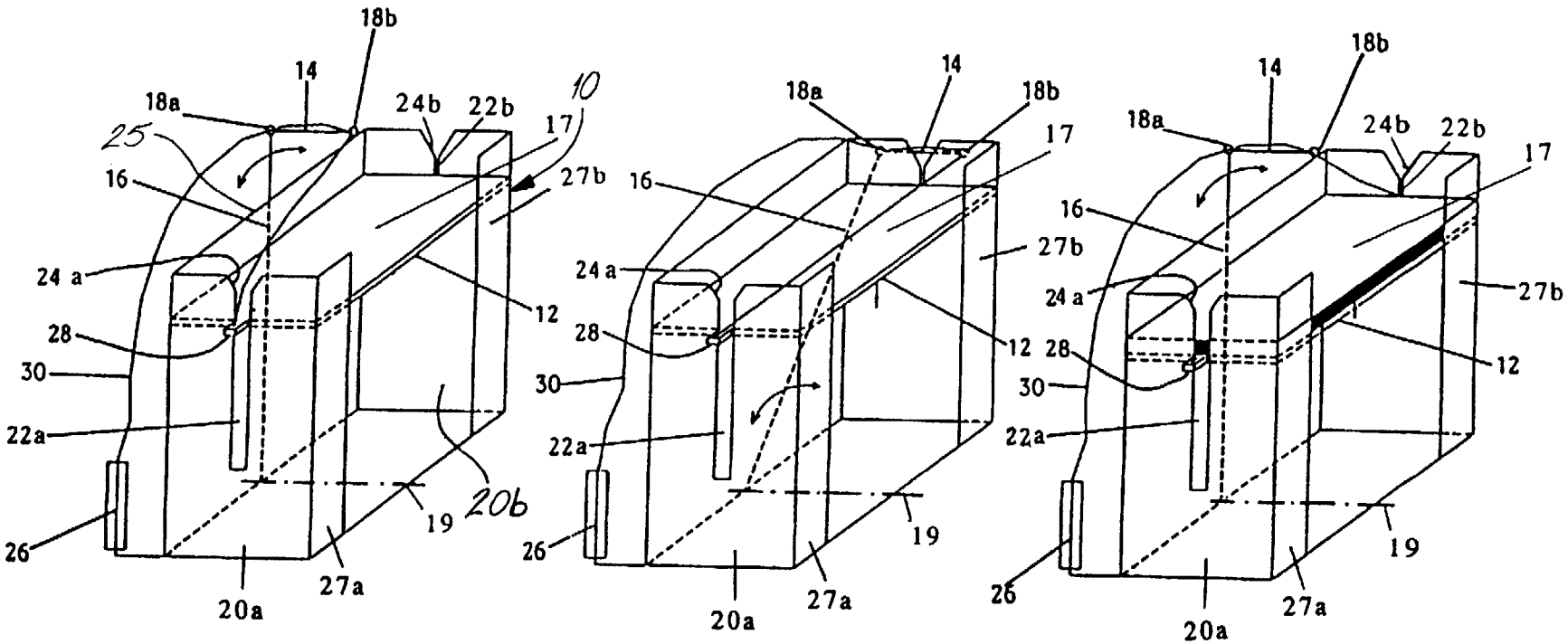
FIG. 1: a perspective representation of the principle of an embodiment according to the present invention.
FIGS. 2–6: the embodiment depicted in FIG. 1 in different intermediate steps of the process according to the invention in schematic, perspective representations.

The advantages to be obtained with the present invention are based on the fact that in the placement of pieces of material to form a stack, a section of a continuous separating strip is provided at the end of each group. The invention also concerns a device which places the separating strip in each case after placement of the last piece of material of a group. The term "separating strip" as used herein refers here to a one-piece, elongated, flexible medium, such as a thin tape, a band, a thread, strip of paper, strip of plastic, or the like.

Special advantages result when the separating strip is placed such that the direction in which a section of the separating strip is placed between two pieces of material of different groups changes with each change of group, such that the separating strip snakes or meanders through the finished stack. To be able to remove a group from the stack later, it is necessary only to pull on the end of the separating strip to raise the top group on one side far enough that it can be easily grasped.

It is also advantageous if even the bottom piece of material in the stack is laid on top of the first section of the separating strip. If the separating strip is later also passed over the last piece of material in the stack and passed around the stack at least once, the stack may then be permanently held together by joining the two ends of the separating strip.

To be able to always place each piece of material in the same place, the base of the stack may advantageously be gradually lowered far enough that the top of the stack essentially remains at the same height, at least at the time of the placement of a section of the separating strip.

To form a stack of grouped pieces of material on a base, a device is provided which has means for securing one end of a separating strip, and means to align the pieces of material on the base, as well as an arrangement to move sequential sections of the separating strip over the top piece of material of each respective group. The arrangement is also capable of either executing a movement around the stack being created or oscillating over the respective top of the stack. Using such a device, the separating strip can either be wrapped around the stack at the time of each group change or placed such that it snakes or meanders through the stack.

A particularly advantageous variation of the device according to the invention results when the separating strip is guided by an arm moving beyond the periphery of the stack and back and forth over its top. For this, the arm has a guide, which can be designed, for example, as a loop, a fork, or the like. The arm may, for example, be guided linearly along a rail or, as is preferred according to the present invention, can be swung oscillatingly back and forth by means of a swivelling lever over the stack being formed. The drive for the arm is disposed such that the placement of pieces of material is not obstructed.

Preferably, the drive has a swivelling lever whose swivelling axis is disposed below the plane containing the top of the stack and parallel thereto. The arm and the swivelling lever together present an L-shaped pattern.

It is particularly advantageous if the stack is formed on a base which is height-variably supported such that the position of this base can be adjusted relative to the guide for the separating strip.

To align the pieces of material on the base, it is preferred to use two side guides spaced from each other, each with a guide slot for the separating strip. The guide slot extends from the top edge of the side guide to the base and makes it possible to guide a section of the separating strip to the top of the base or of a piece of material.

In their preferred embodiment, the guide slots each have a converging cutout starting from their free end. This cutout can also guide the separating strip into the guide slot when the separating strip is, for any reason, not moved absolutely precisely into the guide slot by the guide on the arm.

A preferably stationary holder is provided for a supply of the separating strip, for example, in the form of a spool.

In a grouping process according to the invention, pieces of material in the form of labels with a specific inscription are individually separated from a roll or a stack and fed into a placement area of the device defined by the side guides and the base or the top of the next stack. As soon as the inscription changes, the device according to the invention receives an activation pulse and guides a section of the separating strip over the last label of the relevant group of labels. The next label with a different inscription is placed on top of the separating strip, while the following labels of the same group are placed label on label. As soon as the inscription changes again, the device according to the invention again receives an activation pulse to place another section of the separating strip on top of this group of labels. The direction in which the next section of the separating strip is placed on the respective last label of a group should be opposite the direction for the previous placement of a section of the separating strip. Each following group of labels with a different inscription is not placed directly on the underlying label but, rather, on the separating strip. With each group change, the direction in which the separating strip is placed also changes because it is guided with a group change from one edge of the stack to the other edge and then guided back with the next, forming a serpentine path of the separating strip. When the respective stack with different groups of labels has reached its predefined height, the stack can be removed with the separating strip between the consecutive groups of labels. The placement of the separating strip in a serpentine shape represents a permanent grouping measure that is difficult to unintentionally destroy.

With reference now to the drawing, FIG. 1 depicts a device 10 according to the invention for forming a stack of pieces of material, labels for example, on a base 12. Device 10 is provided with an arm 14 connected with a drive in the form of a swivelling lever 16 with a swivelling axis 19 positioned below the top 17 of the stack and parallel thereto and used to place a separating strip 30, on successive grouping of materials. Together, arm 14 and swivelling lever 16 form an L-shaped pattern. The arm 14 has on its free end a guide **18*b* for the separating strip 30. Between the guide 18*b* and a supply 26 of the separating strip 30, guide elements are provided for guidance of the separating strip 30. A guide element 18*a* is located in the area of the transition from the arm 14 to the swivelling lever 16**.

To align the pieces of material or labels, the device 10 has two parallel side guides, **20*a* and 20*b* spaced from each other. Base 12 is variably supported between these side guides 20*a* and 20*b*. The side guides each have vertical guide slot 22*a* and 22*b*, each with a converging starting cutout 24*a* and 24*b*. Each converging starting cutout 24*a* and 24*b* begins from the top edge of the side guide 20*a* or 20*b* respectively, and is the widest there, and becomes smaller as it goes downward. The guide slots 24*a* and 24*b* are disposed such that they are crossed by the plane on which the separating strip 30 is moved by the guide 18*b*. In the case of a fluttering separating strip 30, they are used for the lateral positioning of the separating strip 30. Moreover, they are necessary to enable placement of a section of the separating strip 30 on the top of the base 12** or of the stack.

As additional means of alignment in this embodiment, a back wall 25 is provided as a link between the two side guides **20*a* and 20*b* as well as two flaps 27*a*, 27*b*, each of which projects from one edge of the side guides 20*a*, 20*b* and which lie in a common plane parallel to the back wall 25**.

On one edge of the base 12, a projection 28 is provided. Projection 28 extends outward from the inside through one of the guide slots 22 and is used to attach the free end of the separating strip 30.

The supply 26 of the separating strip, for example, a spool of thread or cord or wire, is stationarily installed on the device 10 using a holder. The separating strip is guided from the supply 26 through at least one guide element **18*a* and the guide 18*b* to the projection 28 on the base 12**, and attached there by its free end.

The swivelling lever 16 is mounted on the exterior of the back wall 25 such that its swivelling axis 19 runs parallel to and centrally between the side guides **20*a*, 20*b* as well as approximately at the height of a bottom surface of the device 10. The arm 14 can be swivelled back and forth between two extreme positions using the swivelling lever 16. In each of its extreme positions, the arm 14 is located together with the guide 18*b* outside a torus containing the lateral peripheral surfaces of the stack being created. For the purposes of explanation, the extreme position in which the arm 14 is located near the side guide 20*a*, i.e., toward the front in the drawings, is designated as the first extreme position. Accordingly, the second extreme position is that in which the arm 14 is located near the other side guide 20*b***, i.e., toward the back in the drawings.

In FIG. 1, the arm is depicted exactly in the center between the two extreme positions. During the swivelling of the arm 14 from one extreme position to the other, guide **18*b* attached thereto exerts a force on the separating strip 30. Since the separating strip 30 is held stationary in the area of its free end, the force removes or strips a section of the separating strip 30 from the supply 26**.

The motor(s) and a control for driving and controlling the arm 14 and swivel lever 16 and for controlling the height of the base 12 are not shown.

FIG. 2 depicts the device 10 with the arrangement consisting of the swivelling lever 16 and the arm 14. The arrangement (14, 16) is swivelled into its second extreme position. A first section of the separating strip has been guided by a first swivelling motion of the swivelling lever 16 with the arm 14 from the first into the second extreme position once over the base 12 and placed directly on the base. Labels may then be placed on the base 12 and the first section of the separating strip 30.

The arrangement (14, 16) with the guide **18*b* remains in this second extreme position until all the labels of the first group are placed on one another on the base 12 and on the first section of the separating strip 30**.

FIG. 3 depicts the situation after all labels of the first group 40 are placed. The bottom label lies on the first section of the separating strip 30, which, for its part, was placed on the base 12 (FIG. 2). This first section of the separating strip 30 is secured in position by the weight of the labels of the first group. After the last label of the first group 40 has been placed, the swivelling lever 16 is on the way with the arm 14 back to its first extreme position. In the process, it guides a second section of the separating strip 30 over the last label of the first group 40. Simultaneously, a suitable length of the separating strip 30 is pulled from the supply 26.

Figures 4, 5, 6:
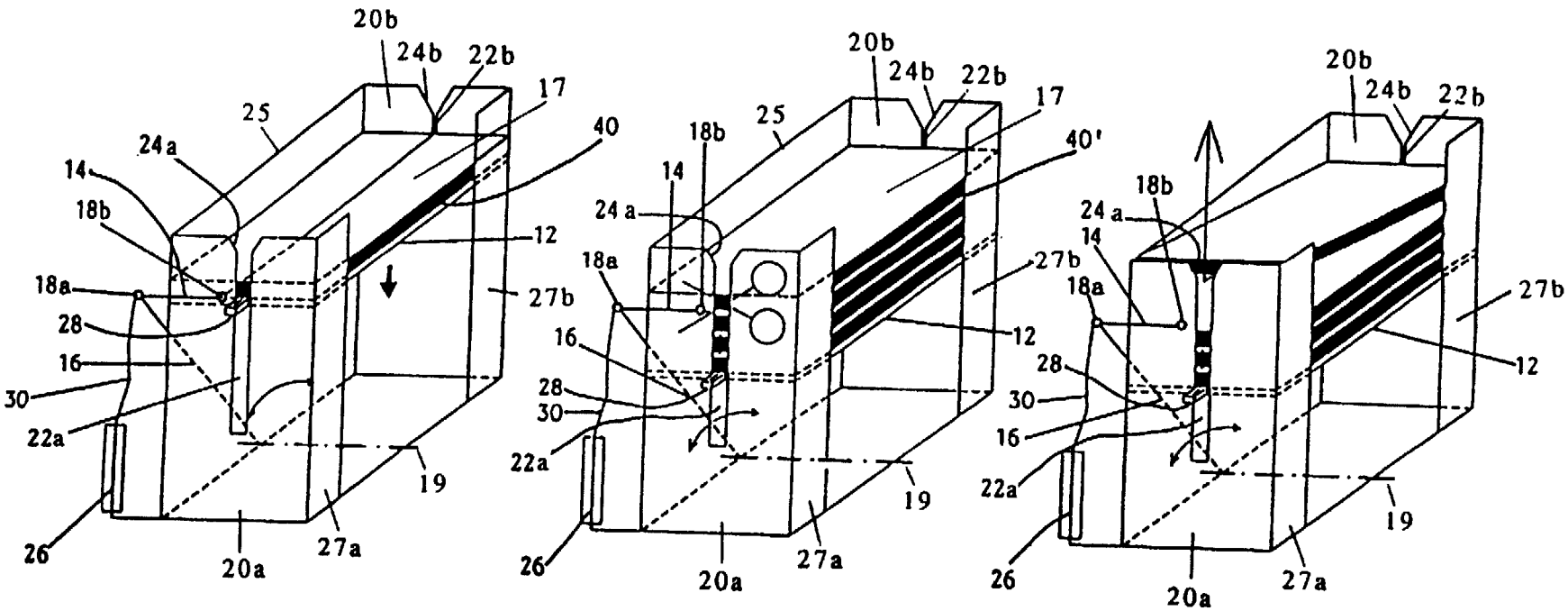

FIG. 4 depicts the swivelling lever 16 with the arm 14 in its first extreme position. The second section of the separating strip 30 now lies on top of the last label of the first group 40 of labels. The base 12, as indicated by the arrow is now lowered far enough that the distance between the plane containing the top of the stack being formed and the guide **18*b* is roughly the same as before the second swivelling movement of the arrangement 14, 16 (FIG. 2**).

Then, the labels of the second group are placed on top of the second section of the separating strip 30. After the last label of the second group is placed, the swivelling lever 16 with the arm 14 is swivelled back to its second extreme position. In the process, an additional length of the separating strip is pulled from the supply and a third section of the separating strip is guided over the last label of the second group. The direction in which the separating strip is guided is again the same as with the placement of the first section of the separating strip.

FIG. 5 depicts the situation after four groups of labels have already been stacked. The swivelling lever 16 with the arm 14 is in its first extreme position. The fourth section of the separating strip lies between the last label of the third group and the first label of the fourth group 40' and is firmly held by the weight of the labels of the group 40'. It should be noted that the base 12 has already been lowered far enough that the plane containing the top of the stack is again at roughly the same distance from the guide **18*b*** as before the second swivelling movement.

FIG. 6 shows how the top group of labels can be removed from the stack by gripping the separating strip 30 between the guide **18*b*** and its last secured section and pulling upward. Thus, the last group of labels is raised on one side far enough that it can easily be removed from the stack.

When the stack of labels as a whole is to be removed from the device 10, it can first be wrapped with an additional section of the separating strip before the separating strip is cut from the separating strip supply and a second free end of the separating strip is produced. Then, the attachment of the first free end of the separating strip on the projection 28 is released and the two free ends are joined together, for example, by a knot. Thus, it is ensured that the labels of the stack are held together. If the union of the two separating strips is later released again, the individual groups can be removed from the stack simply, as described.

The preferred process described and the corresponding device are distinguished in that the separating strip is moved by a guide which moves back and forth oscillatingly above the stack being formed. During this process, the movement of the stack is limited only to a relatively small, gradual lowering movement.

However, alternatively, the stack being formed on the base can also be moved back and forth laterally between two extreme positions. The separating strip is attached to a projection on the base for the stack and extends from there to a stationary guide or a stationary supply which is installed, for example, roughly in the midpoint of the path between the two extreme positions just above the plane containing the top of the stack.

Pieces of material of one group are placed on the stack while it is in one of the extreme positions. After the last piece of material of one group is placed, the stack is moved to the second extreme position. In this process, the stack takes the separating strip laterally along with it and an appropriate length of the separating strip is pulled from the supply. When the stack has reached the second extreme position, a section of the separating strip is located on top of the last piece of material of the last group placed. The first label of the next group is placed on top of this section of the separating strip. After the last piece of material of this group has been placed, the stack is again moved to the first extreme position, with the result that an additional section of the separating strip is then located on top of this piece of material, on which section the pieces of material can then be placed. After the completion of this process, the stack of pieces of material and the separating strip are structured exactly as after the completion of the first process described.

The alternative process is recommended when the pieces of material are to be fed to the stack from different places, since they are produced, for example, by different machines.

What is claimed is:

1. A process for forming a vertically oriented stack of grouped pieces of substantially planar materials which comprises:

(a) providing a horizontally oriented vertically movable base;

(b) attaching to the base a first free end of a continuous separating strip having a first and a last section provided to separate the grouped pieces of materials forming the stack;

(c) layering pieces forming a first group of materials on the base with a lowermost piece of the first group contacting the base and the uppermost piece of the first group facing upwards;

(d) placing a section of the separating strip on the uppermost piece of the first group;

(e) placing a next group of materials forming the stack on the first group of materials with the lowermost piece of the pieces of material forming the next group on top of the uppermost piece of material of the first group and the section of the separating strip located thereon;

(f) completing the stack by alternately adding to such next group of pieces of materials a section of separating strip then groups of pieces of materials; and (g) lowering the vertically movable base during addition of the grouped pieces of materials.

2. The process as claimed in claim 1 in which a first section of separating strip is placed between the base and the lowermost piece of the first group of pieces of materials.

3. The process as claimed in claim 1 in which the last section of the separating strip is placed on the uppermost group of materials.

4. The process as claimed in claim 1 in which after placement of the last group of materials forming the stack, the separating strip is wrapped around the stack at least once.

5. The process as claimed in claim 1 in which after placement of the last group of materials forming the stack, a second end of the separating strip opposed to the first free end is joined to the first end.

6. The process as claimed in claim 1, in which the separating strip forms a serpentine configuration when the stack is formed.

7. The process as claimed in claim 6 in which a first section of separating strip is placed between the base and the lowermost piece of the first group of pieces of materials.

8. An apparatus for forming a stack of grouped pieces of materials which comprises:

(a) a horizontally oriented base;

(b) means to secure one end of a separating strip to said base;

(c) means to align grouped pieces of material on the base to form a vertically oriented stack; and (d) means to add sequential sections of a continuous separating strip over the uppermost piece of each of the grouped pieces of material by arcuately oscillatory movements over the top of the stack undergoing formation.

9. Apparatus as claimed in claim 8 including means to move said base in a substantially vertical oriented direction.

10. Apparatus as claimed in claim 8 in which the means to align grouped pieces of material forming the stack includes opposed walls providing vertically oriented slots extending normal to the base.

11. Apparatus as claimed in claim 10 which includes downwardly sloping guide means extending from uppermost ends of the opposed walls and communicating with the slots.

12. Apparatus as claimed in claim 8 in which the means to add sequential sections of the separating strip comprises an arm adapted to move along the side of a vertically oriented stack and above and beyond the width of the stack, a second arm, normal to the first arm, extending over at least part of the stack, means to oscillate the first arm beyond the width of the pieces of materials forming the stack, and means to engage and feed said separating strip to said second arm for disposing said separating strip over each of the groups of pieces of material.

13. Apparatus as claimed in claim 12, in which said means for oscillating the first arm oscillates said first arm about a point below the base.

14. Apparatus as claimed in claim 12 further including means to hold the continuous separating strip and means for guiding the separating strip from said means to hold the continuous separating strip to said second arm.

15. A process for forming a vertically oriented stack of grouped pieces of substantially planar sheet materials, which comprises:

(a) providing a horizontally oriented base;

(b) attaching to the base a first free end of a continuous separating strip provided to separate the grouped pieces of sheet materials forming the stack;

(c) layering a plurality of pieces of substantially planar sheet materials to form a first group of vertically oriented materials on the base with a lowermost piece of the first group contacting the base and the uppermost piece of the first group facing upwards and vertically spaced from the lowermost piece;

(d) placing a section of the separating strip on the uppermost piece of the first group;

(e) placing a next group of a plurality of substantially planar sheet materials forming the stack on the first group of materials with the lowermost piece of the pieces of material forming said next group on top of the uppermost piece of material of the first group and the section of the separating strip located thereon; and (f) completing the stack by alternately adding to such next group of a plurality of vertically oriented planar pieces of materials a section of separating strip then groups of vertically oriented pieces of substantially planar sheet materials.

16. A process, as claimed in claim 15, in which the substantially planar sheet materials are labels.

* * * * *

UNITED STATES PATENT AND TRADEMARK OFFICE

CERTIFICATE OF CORRECTION

PATENT NO. : 5,775,872

DATED : July 7, 1998

INVENTOR(S) : Maximilian R. Seidl; Manfred Adler

It is certified that error appears in the above-indentified patent and that said Letters Patent is hereby corrected as shown below:

On the title page:

Item 56, Refereces cited, Foreign Patent Documents, Replace

"131039 5/1987 U.S.S.R.....414/789.5" with

-- 1312039 5/1987 U.S.S.R.....414/789.5 --

Column 4, line 15, change "slot" to -- slots --.

Signed and Sealed this

Twentieth Day of April, 1999

*Attest:*

Q. TODD DICKINSON

*Attesting Officer*

*Acting Commissioner of Patents and Trademarks*